US007337933B1

(12) United States Patent
Klinberg

(10) Patent No.: US 7,337,933 B1
(45) Date of Patent: Mar. 4, 2008

(54) POCKET SHOE HORN WITH TELESCOPIC HANDLE

(76) Inventor: Valeriy Klinberg, 40445 Springhurst Gardens Cir., Louisville, KY (US) 40241

( * ) Notice: Subject to any disclaimer, the term of this patent is extended or adjusted under 35 U.S.C. 154(b) by 96 days.

(21) Appl. No.: 11/512,579

(22) Filed: Aug. 30, 2006

(51) Int. Cl.
*A47G 25/82* (2006.01)

(52) U.S. Cl. ..... 223/118

(58) Field of Classification Search ..... 223/1, 223/111–119
See application file for complete search history.

(56) References Cited

U.S. PATENT DOCUMENTS 1,424,030 A * 7/1922 Peck ..... 223/118
3,788,531 A * 1/1974 Oldfield ..... 223/118
4,516,704 A * 5/1985 Hagman ..... 223/111
D302,490 S * 8/1989 Denney ..... D2/642
5,063,628 A * 11/1991 Campbell ..... 7/116
5,392,800 A * 2/1995 Sergi ..... 135/65
5,961,012 A * 10/1999 Bucher ..... 223/119
D427,417 S * 7/2000 Israel ..... D2/642
6,695,182 B1 * 2/2004 Shrewsbury ..... 223/113
2004/0255995 A1 * 12/2004 Garrett ..... 135/66

* cited by examiner

*Primary Examiner*—Gary L. Welch
*Assistant Examiner*—Andrew W Sutton

(57) ABSTRACT

A shoe horn device has a series of telescoping sleeves which telescope within the handle for storage and extend out for use. A shoe horn shaped pivotable head attaches to an outer end of the innermost sleeve. The pivotable head pivots over, locks, and nests with the handle in a pocket storage configuration. The pivotable head pivots open for use as a long handled shoe horn. A variety of different pivotable heads may be attached as individual replacement heads.

8 Claims, 4 Drawing Sheets

POCKET SHOE HORN WITH TELESCOPIC HANDLE

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to shoe horns and particularly to a shoe horn device having a handle grip with a long telescoping handle extension and a shoe horn head at an opposite end of the handle extension which folds over the handle in its retracted position for a more compact arrangement to fit into a pocket or purse of a user, wherein the shoe horn head is replaceable with other types of heads for use with the device.

2. Description of Related Art Including Information Disclosed Under 37 CFR 1.97 and 1.98

A shoe horn is a great aide and often necessary to assist a user in inserting a foot into a shoe or slipping a shoe over a foot, especially for very tight-fitting shoes. A long handled shoe horn is a great convenience for putting on a shoe without bending over by simply holding the shoe horn against an inside back of a shoe from a standing position while slipping the foot into the shoe. For people who cannot bend over, such as people with leg injuries, or cannot easily bend over, such as elderly or other joint stiffened people, a long handled shoe horn is a necessity for putting on shoes without bending over.

With the current mobile lifestyle and various activities away from home requiring having to removes shoes and put them on again having a portable long handle shoe horn is a great convenience to some and necessity to others as indicated above. Some such situations include exercise classes or sports participation, such as swimming or bowling, medical visits, or just trying on clothing or shoes at a self-service shoe store. Prior art devices do not address this problem in an easy-to-use compact portable shoe horn which extends out to a useful length.

U.S. Pat. No. 6,695,182, issued Feb. 24, 2004 to Shrewsbury, depicts an extendable shoehorn device for permitting a user to put a shoe on a foot without having to bend over. The extendable shoehorn device includes a handle assembly having a pocket clip thereon. An offset shoehorn member is mounted to an end of the handle assembly for permitting a user to more easily put a shoe on their foot.

U.S. Pat. No. D302,490, issued Aug. 1, 1989 to Denney, provides the ornamental design for a shoe horn.

U.S. Pat. No. 4,355,745, issued Oct. 26, 1982 to Nelson, shows a specially constructed shoe horn for persons having limited body bending movements. The device has an elongated pivotable handle, which enables a person to put on footwear without substantial bending at the waist, hips or knees.

U.S. Pat. No. 5,884,823, issued Mar. 23, 1999 to Carroll, claims a collapsible shoe horn that includes a shoe horn tongue having a generally thin and smooth body portion for aiding the user in putting on a pair of shoes. The side edges of the shoe horn tongue are slightly curved upwardly in a concave manner so that the shoe horn tongue conforms to the shape of the heel of a human foot. A neck portion is integral with and extends from the bottom of the shoe horn tongue. The neck portion has a pair of opposing flanges, each flange having a dap opening formed within the interior side thereof for receiving opposing ends of a shoe horn handle. The dap openings have a smooth dimple-like dap surface extending from the outer exposed surface of each neck flange for protecting the shoe horn user from the sharp ends of the shoe horn handle.

U.S. Pat. No. 6,386,216, issued May 14, 2002 to Cubelli, describes a cane and grasping device provided with a shoehorn. An upper tubular member is telescoped within a lower sleeve or sheath having a cane foot at its lowermost end. The sleeve is adjustably set along the member to set the length of the cane by a detent assembly employing a pawl and aperture arrangement. An article grasping mechanism is located at the lower end of the upper tubular member and includes a pair of toothed jaws with meshing teeth. The jaws extend from the tubular member at one end, opposite a handle attached to the tubular member at the other end. A lever is attached at the handle end and is coupled to the jaws via cables and pulleys. The jaws are biased open and are closed by the cables as the handle is squeezed closed. The sleeve encloses the jaws in the closed state when not in use. When the sleeve is removed from juxtaposition over the jaws, the jaws are biased open by torsion springs. The handle and lever are then used to close the open jaws over an article to be grasped.

U.S. Pat. No. 3,788,531, issued Jan. 29, 1974 to Oldfield, claims a collapsible shoehorn with two shoehorn curved sections telescoping together for storage and telescoping out for usage.

U.S. Patent Application #20040255995, published Dec. 23, 2004 by Garrett, illustrates a walking stick having a shoehorn/gripper and magnet accessories. The walking stick or cane comprises a support having a foot at one end thereof and a handle at the other. A gripper device adjacent the foot includes a shoehorn assembly pivoted to the support for movement toward and away from the foot for grasping objects between the end of the foot and the shoehorn assembly. The gripper device is operated by a trigger mounted adjacent the handle and a rod generally parallel to the support. In one embodiment, the shoehorn assembly includes a shoehorn which acts to grasp an object. The walking stick may have an adjustable length, by providing telescoping sections.

What is needed is an easy-to-use compact portable shoe horn which fits into a pocket or purse of a user and opens easily and extends out into a shoe horn with a rigid elongated handle extension of a useful length.

BRIEF SUMMARY OF THE INVENTION

An object of the present invention is to provide an easy-to-use compact portable shoe horn with a handle grip having a long handle extension which telescopes closed and has a shoe horn head pivotally attached to on outer end of the handle extension which pivots and locks in place over the handle for a compact unit which fits into a pocket or purse of a user for storage and transportation and opens easily by snapping the shoe horn end open away from the handle extension in a locked open position with the handle extension telescoping out to form a shoe horn with a rigid elongated handle of a useful length.

A related object of the present invention is to provide a handle grip which fits comfortably in a hand of a user and has a handle extension in the form of a series of telescoping sleeves with a shoe horn shaped pivotable head on an outer end of an outer sleeve which pivots open for use while holding the handle and pivots closed nesting with the handle with the sleeves all telescoped together inside the handle.

Another object of the present invention is to provide replaceable pivotable heads which may include a shoe horn, a back-scratcher, a pick-up magnet, a pick-up hand, or other types of heads requiring an extended length handle.

In brief, the handle grip has a handle extension formed by a number of increasingly smaller sleeves which telescope together to fit within the handle to provide a pocket size item with the handle extension telescoped down and a shoe horn head at an outer end of the sleeves pivoted over the handle and which sleeves telescope out to form the handle extension to make the handle a useful length and with the shoe horn head pivoted open to enable a person to use the shoe horn in a standing position.

The handle extension comprises of a series of tubular sleeves telescoping into each other which telescope down to fit within the handle grip.

The pivotable head is attached to an outer end of an innermost sleeve by a pivotable means of allowing the pivotable head to pivot open and lock in an extended work configuration and pivot closed and lock in a folded over storage configuration and a removable means of attaching the pivotable head to the innermost telescoping sleeve.

A folding shoe horn is one of a number of removable interchangeable pivotable heads attachable to the telescopic sleeve. Other tips would include magnetic pick-up, back scratch, golf putter, golf ball pick up, grasping device, etc.

With the telescoping rod collapsed and the shoe horn folded over it, it then becomes pocket size. Unfolded and extended, the shoe horn would be twenty-nine to thirty inches long.

An advantage of the present invention is that it provides a useful long handled shoe horn which enables use in a standing position and collapses down to fit in a pocket or purse.

Another advantage of the present invention is that it provides a portable pocket tool with a collapsible and expansible handle having a variety of replaceable heads for different functions.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
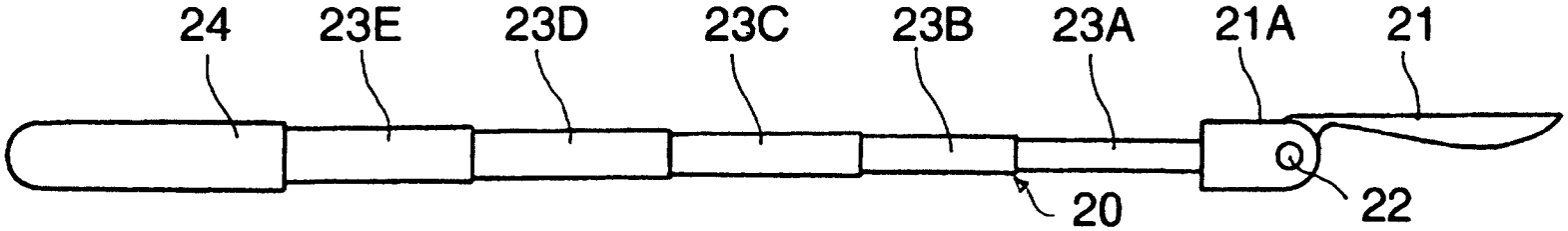
FIG. 1 is a side elevational view of the telescoping and folding long handled shoe horn device of the present invention in a fully expanded configuration with the handle grip portion seen at a left end and the pivotable head shoe horn seen at a right end pivoted open at an outer end of the extended telescoping sleeves.
Figure 2:
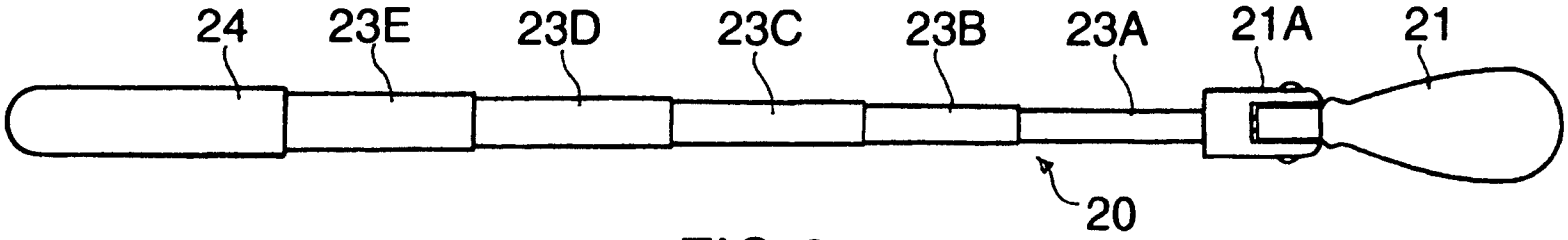
FIG. 2 is a top plan view of the present invention of FIG. 1.
Figure 4:
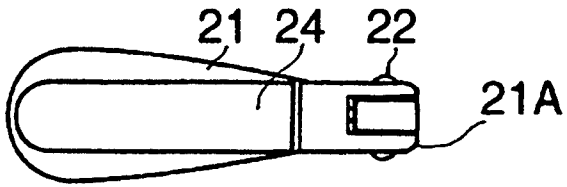
FIG. 4 is a top plan view of the present invention of FIG. 3 in the fully contracted configuration.
Figure 3:
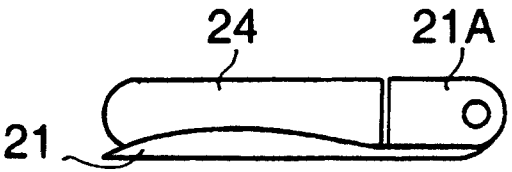
FIG. 3 is a side elevational view of the present invention of FIG. 1 with all of the sleeves telescoped together in the handle and the pivotable head folded over and nesting with the handle grip so that the device is fully contracted for storage.

In FIGS. 1-8, a telescoping and pivoting shoe horn device 20 comprises a hand grip handle 24 at one end having a series of telescoping sleeves 23A-23E which slide inside the handle with a pivotable head 21 in the shape of a shoe horn pivotally attached to a head base 30 attached to an outer end of the inner sleeve 23A and the pivotable head pivots open with the sleeves fully extended into a handle extension for use as a shoe horn with an elongated handle, as shown in FIGS. 1 and 2, and alternately, with the sleeves telescoped together within the handle, the pivotable head 21 pivots closed over the handle 24 nesting with the handle, as shown in FIGS. 3 and 4, for compact storage in a pocket or purse.

The collapsible and expansible handle comprises an outer gripping portion 24 and a series of increasingly smaller sleeves 23E, 23D, 23C, 23B, and 23A which telescope together to fit within the outer gripping portion in a fully collapsed position, as shown in FIGS. 3 and 4, to fit within a pocket of a user. These sleeves 23A-23E telescope out to a fully extended configuration to form a handle extension for use as an elongated handle, as shown in FIGS. 1 and 2, to enable a user holding a proximal end of the handle to contact a floor with a distal end of the handle from a standing position. The device can be held from the hand grip end to use as a long-handled shoe horn.

Figure 5:
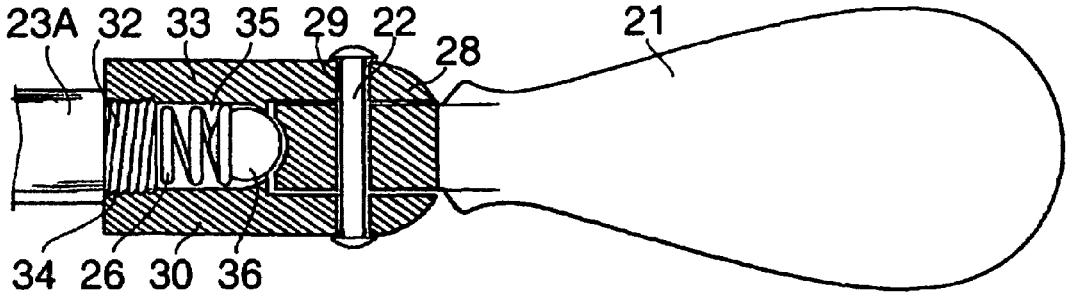
FIG. 5 is a top plan view in partial section of the shoe horn head base showing the pivot and locking connection between the pivotable head and a threaded outer end of the innermost telescoping sleeve and a mating threaded opening in the pivotable head base.

A pivotable head 21 and 30 attaches to an outer end of an innermost extensible telescoping sleeve 23A by a means for pivoting the pivotable head from a first locked position pivoted over the handle 24 and the telescoping sleeves 23A-23E in the fully collapsed position, as shown in FIGS. 3 and 4, to a second locked position pivoted away from the handle and the telescoping sleeves 23A-23E in the fully extended position, as shown in FIGS. 1, 2, and 5.

In FIGS. 5-8, the means for attaching the pivotable head comprises a pivotable head base 30 comprising a first end 33 having a means for attaching the pivotable head base to the threaded outer end 32 of the innermost sleeve 23A and a second end having flanges 28 with two opposing parallel flat sides having a base pivot pin hole 29 therethrough with a pivot pin 22 through the base pivot pin hole 29 and a perpendicular cylindrical opening 35 therethrough with a spring-loaded locking ball 36 and a communicating spring 26 positioned within the cylindrical opening with the ball 36 protruding from the head base perpendicular to the base pivot pin hole 29 and a pivotable head comprising a connective end 27 protruding orthogonally between the two parallel flanges 28 of the base 30, each of the flanges having a center flange pivot hole 29 for receiving an end of the pivot pin 22 therein the connective end 27 of the pivotable head base comprising three grooves 31A-31C so that when the pivotable head is pivoted open in the fully extended position the ball 36 engages a first groove 31A to lock the pivotable head in a pivoted open position and when the pivotable head is pivoted into the second position the ball 36 engages the second groove 31B to lock the pivotable head in a pivoted open position at an angle and when the pivotable head is pivoted closed in a closed position over the handle the ball 36 engages a third groove 31C to lock the pivotable head in the pivoted closed position. When a user applies force to pivot the pivotable head 21, the pivotable head pivots to release the ball unlocking the pivotable head.

Figure 6:
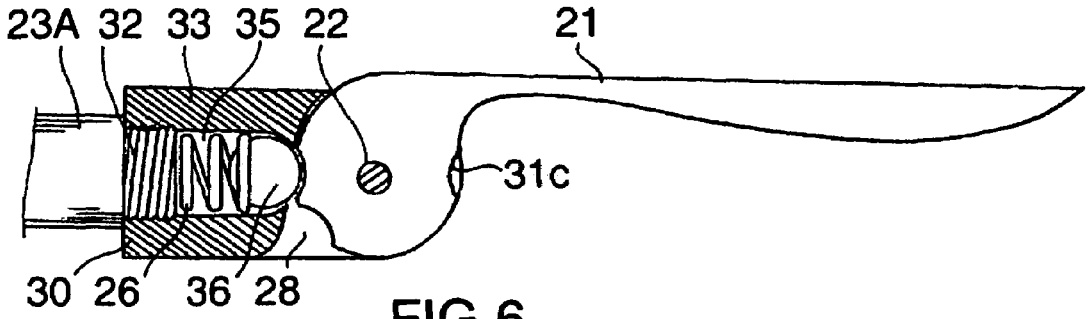
FIG. 6 is a side elevational view in partial section of the pivotable shoe horn shaped head showing the pivot and locking connection between the pivotable shoe horn head and head base.
Figure 7:
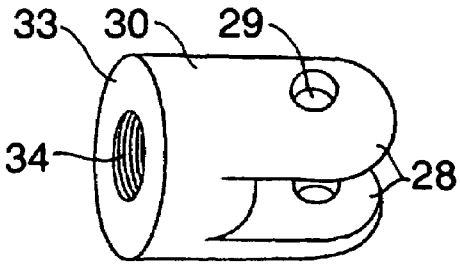
FIG. 7 is a perspective view showing the flanges of the head base which connects to the pivotable shoe horn head.
Figure 8:
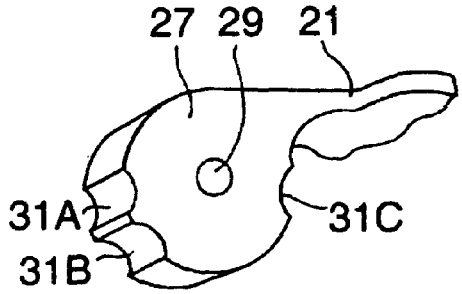
FIG. 8 is a partial perspective view showing the pivotable shoe horn head.

In FIGS. 5-7, one means for attaching the pivotable head base 30 to the outer end of the innermost sleeve 23A comprises a protruding threaded outer end 32 of the innermost sleeve 23A and a mating threaded opening 34 in a connecting portion 33 of the pivotable head base 30 to receive the protruding threaded outer end 32 to lock the pivotable head base 30 to the outermost sleeve 23A.

Figure 9:
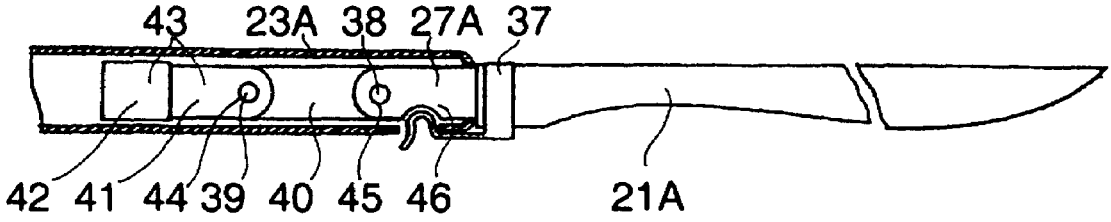
FIG. 9 is a side elevational view in partial section of the pivotable shoe horn head in open position showing an alternate mechanism which comprises the connection between the pivotable shoe horn head and innermost extensible sleeve.
Figure 10:
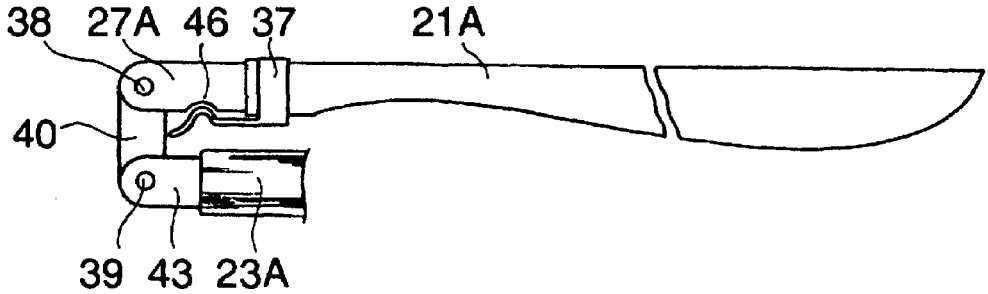
FIG. 10 is a side elevational view in partial section of the pivotable shoe horn shaped head of FIG. 9 in folded position.

In FIGS. 9-10, an alternate means for attaching the shoe horn head 21A to the innermost sleeve 23 A comprises a hollow cylindrical outer end of the innermost sleeve 23A and head base 43 pivotally attached to a link 40 that is pivotally attached to the connective end 27A of the shoe horn head 21A. The head base 43 comprises a first cylindrical end 42 which is larger in diameter than the opening of the hollow cylindrical outer end of the innermost sleeve 23A thereby having means for sliding inside the innermost sleeve 23A without the possibility of sliding out of it and a second cylindrical end 41 having flanges having a base pivot pin hole 44 through which a pivot pin 39 connects the head base 43 to the link 40. The link 40 has a second pivot pin hole 45 which connects to the shoe horn head base 27A via pivot pin 38. When the pivotable head 21A pivots open and is in line with the link 40 and the shoe horn base 43 the connective end 27A slides within the innermost sleeve 23A, there is a spring clip 37 attached to the pivotable shoe horn head 21A to lock the pivotable head in a pivoted open position through the hole in the wall of the innermost sleeve 23A which aligns with the dent 46 in the connective end of the pivotable shoe horn head. When spring clip is disengaged from the dent 46, the pivotable shoe horn head 21A, link 40, and the second end 41 of the shoe horn base 43 is pulled out of the innermost sleeve 23A and pivoted closed into a closed position over the handle.

Figure 11:
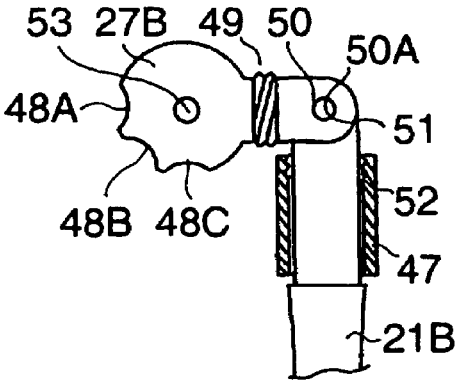
FIG. 11 is a side elevational view in partial section of the pivotable shoe horn shaped head in a folded position showing an alternate mechanism which comprises the connection between the pivotable shoe horn head and head base.
Figure 12:
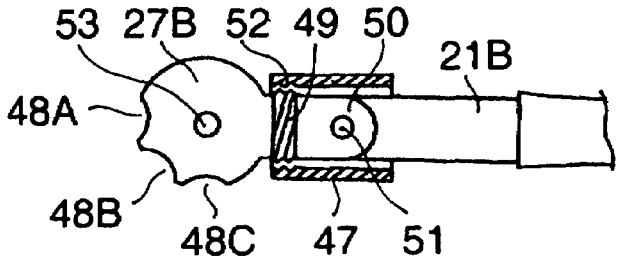
FIG. 12 is a side elevational view in partial section of the alternate shoe horn head base of FIG. 11 in open position.

In FIGS. 11-12, an alternate pivotable head consists of a pivotable shoe horn head 21B having a pivot pin hole 50 and a connective end 27B having a pivot pin hole 50A. A pivot pin 51 connects the shoe horn head 21B to the connective end 27B. The shoe horn head 21B has a sleeve 47 having means for sliding toward the connective end 27B when the pivotable shoe horn head 21B is pivoted open. The connective end 27B has thread 49 which engages a mating thread 52 inside of the sleeve 47 to lock the pivotable head in a pivoted open position. When the thread is disengaged the sleeve 47 slides toward the pivotable shoe horn head 21B, which is in turn pivoted into the closed position.

Figure 13:
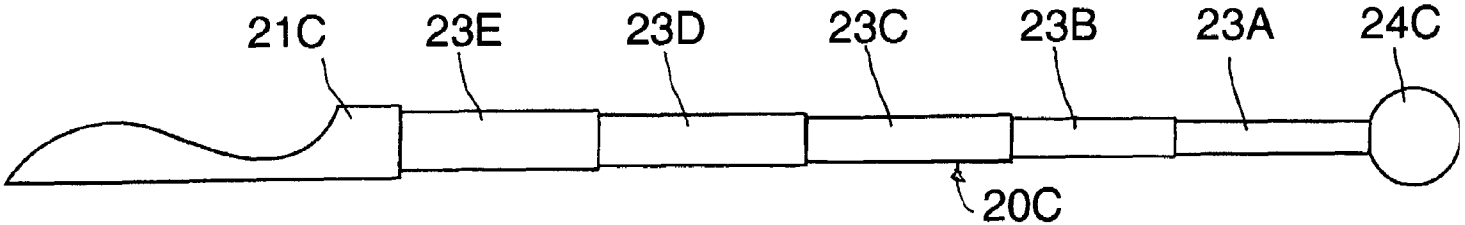
FIG. 13 is a side elevational view of an alternate telescoping shoe horn device of the present invention in a fully expanded configuration with the shoe horn portion seen at a left end and the knob-like handle at a right end of the extended telescoping sleeves.
Figure 14:
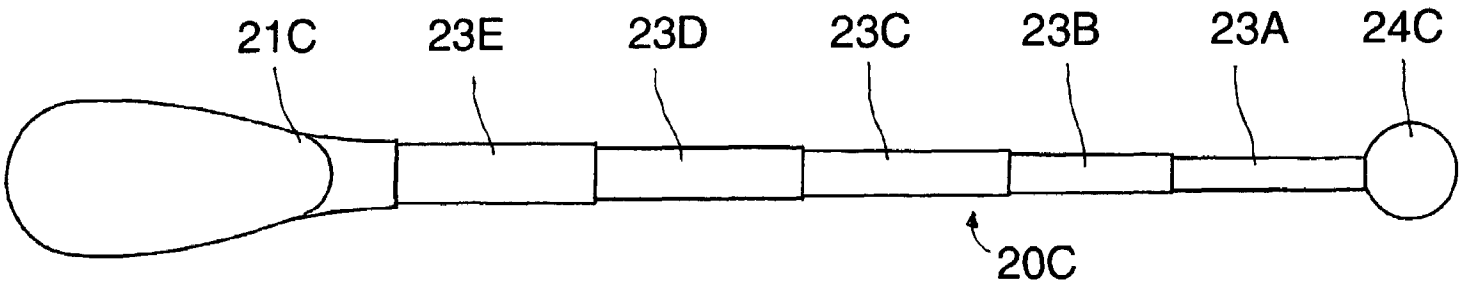
FIG. 14 is a top plan view of the present invention of FIG. 13.
Figure 16:
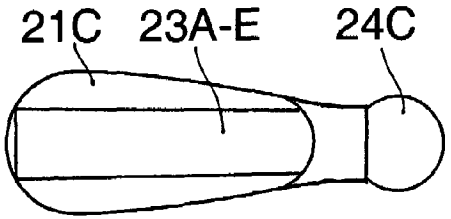
FIG. 16 is a top plan view of the present invention of FIG. 14 in the fully contracted configuration.
Figure 15:
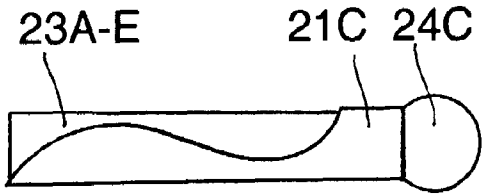
FIG. 15 is a side elevational view of the alternate telescoping shoe horn device of the present invention of FIG. 13 with the sleeves housed within the outer shoe horn shaped largest sleeve so that the device is fully contracted for storage.

In FIGS. 13-16 a telescoping shoe horn device 20C comprises a knoblike handle 24C at one end and a series of telescoping sleeves 23A-23E which are slidable inside the shoe horn shaped outer sleeve 21C so that when sleeves 23A-23E and shoe horn shaped sleeve 23C are fully extended, they create a handle extension for use as a shoe horn with an elongated handle as shown in FIGS. 13 and 14. Additionally, when sleeves 23A-23E and shoe horn shaped sleeve 23C are fully telescoped together and collapsed within the shoe horn shaped sleeve 21C as shown in FIGS. 15-16, the shoe horn device 20C becomes compact for storage in a pocket or purse.

The components are preferably fabricated of metal or sturdy plastic.

It is understood that the preceding description is given merely by way of illustration and not in limitation of the invention and that various modifications may be made thereto without departing from the spirit of the invention as claimed.

I claim:

1. A compact portable shoe horn device having long telescoping handle extension and a shoe horn attached to the opposite end of the handle the way that collapsed, telescoping handle extension folds over toward shoe horn or telescopes down to fit within the shoe horn for storage and fully extended forms a shoe horn with a rigid elongated handle of a useful length comprising: a telescoping and pivoting shoe horn device comprising a collapsible and expansible handle comprising an outer gripping portion and a series of increasingly smaller sleeves which sleeves telescope together to fit within the outer gripping portion in a fully collapsed position to fit within a pocket of a user and which sleeves telescope out to a fully extended position to form a handle extension for use as an elongated handle to enable a user holding a proximal end of the elongated handle to contact a floor with a distal end of the handle from a standing or sitting position;

a pivotable shoe horn head attached to an outer end of an innermost telescoping sleeve comprises a pivotable head base comprising a first end having a means for attaching the pivotable head base to the outer end of the innermost sleeve and a second end having flanges with two parallel flat sides having a base pivot pin hole therethrough with a pivot pin through the base pivot pin hole and a perpendicular cylindrical opening with a spring-loaded locking ball positioned within the cylindrical opening with the ball protruding from the base perpendicular to the base pivot pin hole and a pivotable head comprising a connective end protruding orthogonally between the two parallel flanges of the base and the shoe horn where each of the flanges have a center flange pivot hole for receiving an end of the pivot pin therein so when the connective end of the pivotable head which has three grooves so that when the pivotable head is pivoted open in the fully extended position the ball engages a first groove to lock the pivotable head in a pivoted open position and when the pivotable head is pivoted closed in a closed position over the handle the ball engages a second groove to lock the pivotable head in the pivoted closed position, wherein a user applies force to pivot the pivotable head, the pivotable head pivots to release the balls unlocking the pivotable head and when the ball engages the middle groove it locks the pivotable head at an angle making it convenient to use the device in a sitting position.

2. The device of claim 1 wherein the pivotable head is removable from the outermost telescoping sleeve and replaceable thereon by any of a variety of heads.

3. The device of claim 1 wherein the pivotable head is removable from the outermost telescoping sleeve and replaceable thereon by one of a variety of heads taken from the list of heads including a shoe horn, a back scratchier, a grasper for retrieving external items, a magnetic pick up for retrieving external metal items, telescopic mirror, golf putter, and a golf ball pick up.

4. The device of claim 1 wherein the means for attaching the pivotable head base to the outer end of the innermost sleeve comprises a protruding threaded outer end of the innermost sleeve; and a mating threaded opening in the pivotable head base to receive the protruding threaded outer end to lock the pivotable head base to the innermost sleeve.

5. The device of claim 1 wherein the alternate means for attaching the pivotable head to the outer end of the innermost sleeve comprises a hollow cylindrical outer end of the innermost sleeve and head base pivotally attached to the link that is pivotally attached to the connective end of the pivotable shoe horn head where the head base comprises a first cylindrical end which is larger in diameter than the opening of a hollow cylindrical outer end of the innermost sleeve having means for sliding inside the innermost sleeve without being able to slide out of it and second cylindrical end having flanges having base pivot pin hole therethrough with a pivot pin through the base pivot pin hole so when the pivotable head pivots open and is in line with the link and shoe horn base the connective end of shoe horn head slides within the innermost sleeve where it is locked with spring clip connected to shoe horn head body so in this position and with telescopic sleeves telescoped out to a fully extended position this device forms a shoe horn with an elongated handle and when unlocked the connective end of the shoe horn head link and the shoe horn head base are pulled out of the innermost sleeve and pivoted closed in a closed position over the handle.

6. The device of claim 1 wherein the alternate means for attaching the pivotable shoe horn head base to the pivotable handle base comprises a pivotable shoe horn head having a pivot pin hole on the end and connective end having a pivot pin hole therethrough with a pivot pin through the pivot pin holes and the shoe horn head which has a sleeve having means for sliding toward the connective end when pivoted shoe horn head is pivoted where the connective end has thread which engages a mating thread inside of the sleeve to lock the pivotable head in the pivoted open position so when the thread disengages, the sleeve slides toward the pivotable shoe horn head, which in turn pivots closed in the pivoted closed position.

7. The device of claim 1 wherein the outer gripping portion is replaceable thereon by a shoe horn shaped sleeve.

8. The device of claim 7 wherein an alternate device comprises a knoblike handle in place of removable pivotable shoe horn head and a series of telescoping sleeves slidable inside the shoe horn shaped outer sleeve, so when the sleeves are fully extended into a handle extension for use as a shoe horn with an elongated handle and alternatively with the sleeves telescoped together within the shoe horn shaped sleeve for compact storage in a pocket or purse.

* * * * *